United States Patent [19]

Kapp

[11] 3,977,106

[45] Aug. 31, 1976

[54] NUTRITION INDICATING DEVICE

[76] Inventor: Lois Kapp, 1127 E. Del Mar Blvd., Pasadena, Calif. 91106

[22] Filed: Dec. 12, 1974

[21] Appl. No.: 532,026

[52] U.S. Cl. ..... 40/70 R; 35/74

[51] Int. Cl.[2] ..... G09F 11/04

[58] Field of Search ..... 40/70 R; 35/1, 74; 116/133; 235/83, 88

[56] References Cited

UNITED STATES PATENTS

| | | | |
|---|---|---|---|
| 2,111,268 | 3/1938 | Kohlenberger | 40/70 R |
| 2,592,106 | 4/1952 | Askeli | 35/74 |
| 2,747,299 | 5/1956 | Herzog et al. | 40/70 R X |
| 3,432,942 | 3/1969 | Jack | 40/70 R X |
| 3,769,728 | 11/1973 | Yung-Cheh Lu | 40/70 R |

*Primary Examiner*—Russell R. Kinsey
*Assistant Examiner*—John H. Wolff
*Attorney, Agent, or Firm*—D. Gordon Angus; Donald D. Mon

[57] ABSTRACT

There is disclosed a nutrition-indicating device comprising a flat circular chart with a flat wheel rotatably pivoted at each side of the chart. The diameters of the wheels are the same and are less than the diameter of the chart so that a peripheral margin is left uncovered by the wheels on both sides of the chart. The names of different foods appear around this exposed periphery on both sides of the chart and the areas occupied by a number of the food names are given a color which is not the same for all foods. There are a plurality of such colors and the different colors represent different amounts of cholesterol in the food associated with the color. The particular colors disclosed are yellow, green, blue, purple, red and orange, which represent respectively: absence, trace, small, medium, large and abundance of cholesterol. Sectors of the chart are provided with a plurality of the same colors, representing respectively: absence, trace, small, medium, large and abundance of various named food items including vitamins which appear on each wheel. Thus, there is a column radially extending from the food on the chart toward the center of the circle. Overlying the radially extending colors there is a system of numbers, namely 0, 1, 2, 3, 4 and 5, representing respectively: absence, trace, small, medium, large and abundance of the respective food items. The use of the numbers overlying the colors in the same areas increases the amount of food item information provided by the device. For the purpose of further increasing the amount of space for identification of the various food items on the wheels, there are provided two of the columns of holes through the wheels in proximity but spaced somewhat from each other. In addition to the listing of food items, one of the holes of each wheel represents calories and the corresponding numbers on the chart are in terms of number of calories in 100 grams of the food. The number system and the color system for relative quantities of food items appears on the wheels so that the color or number of the food item corresponding to any listed food can readily be ascertained in terms of absence, trace, small, medium, large or abundance of that food item.

5 Claims, 3 Drawing Figures

NUTRITION INDICATING DEVICE

This invention relates to a nutrition-indicating device, more particularly to such a device which can indicate relative quantities of items in a food.

Nutrition charts containing a rotatable wheel have heretofore been known and used, but none of them has been comprehensive in furnishing qualities of foods and none has heretofore afforded a ready reading of a relative quantity of a nutrient or vitamin.

An object of the present invention is to show quantities of items in a relatively great number of foods on a relatively small device.

A related object is to indicate cholesterol and calory content in addition to food items and vitamins.

The invention is carried out by the provision of a flat chart containing a system of indicia representing a number of different foods arranged in a circular array. The preferred form of indicia comprises ordinary names of the respective foods. A wheel pivoted to the chart overlies part of the side of the chart bearing the indicia or names of the foods. The wheel contains at least one radial column of spaced holes which, by rotating the wheel, can be placed in registration with a selected food on the chart. A second and a third indicia system on the chart, also in radial columns, represent relative quantities of food items such as nutrients and vitamins in the food, and may include calories. The holes of the column uncover respective ones of the second and third indicia for the different foods as the wheel is rotated on the chart.

A preferred feature resides in the use of numbers for the second indicia system and the use of colors for the third indicia system.

Another preferred feature resides in the overlying of second and third indicia in the same areas to be uncovered by respective holes thereby increasing the amount of food item information which may be provided on a chart of a given size. A fourth indicia system is optionally but preferably associated with the indicia or names of respective foods on the chart, representing a food element such as cholesterol.

Another preferred feature resides in a display of relative values of food items for comparison with values read from the chart through the holes or at the peripheral part of the chart.

Another preferred feature resides in the use of two identical wheels, one on each side of the flat chart, in which case both sides of the chart will contain first, second, third and fourth indicia arranged as described above in respect to the first-mentioned side of the chart and providing similar information.

By use of a device according to this invention a simple inspection of relative quantities of food items or values in a food is afforded and a relatively great amount of food item information can be made available on the chart.

The foregoing and other features of the invention will be better understood from the following detailed description and the accompanying drawings of which:

Figure 1:
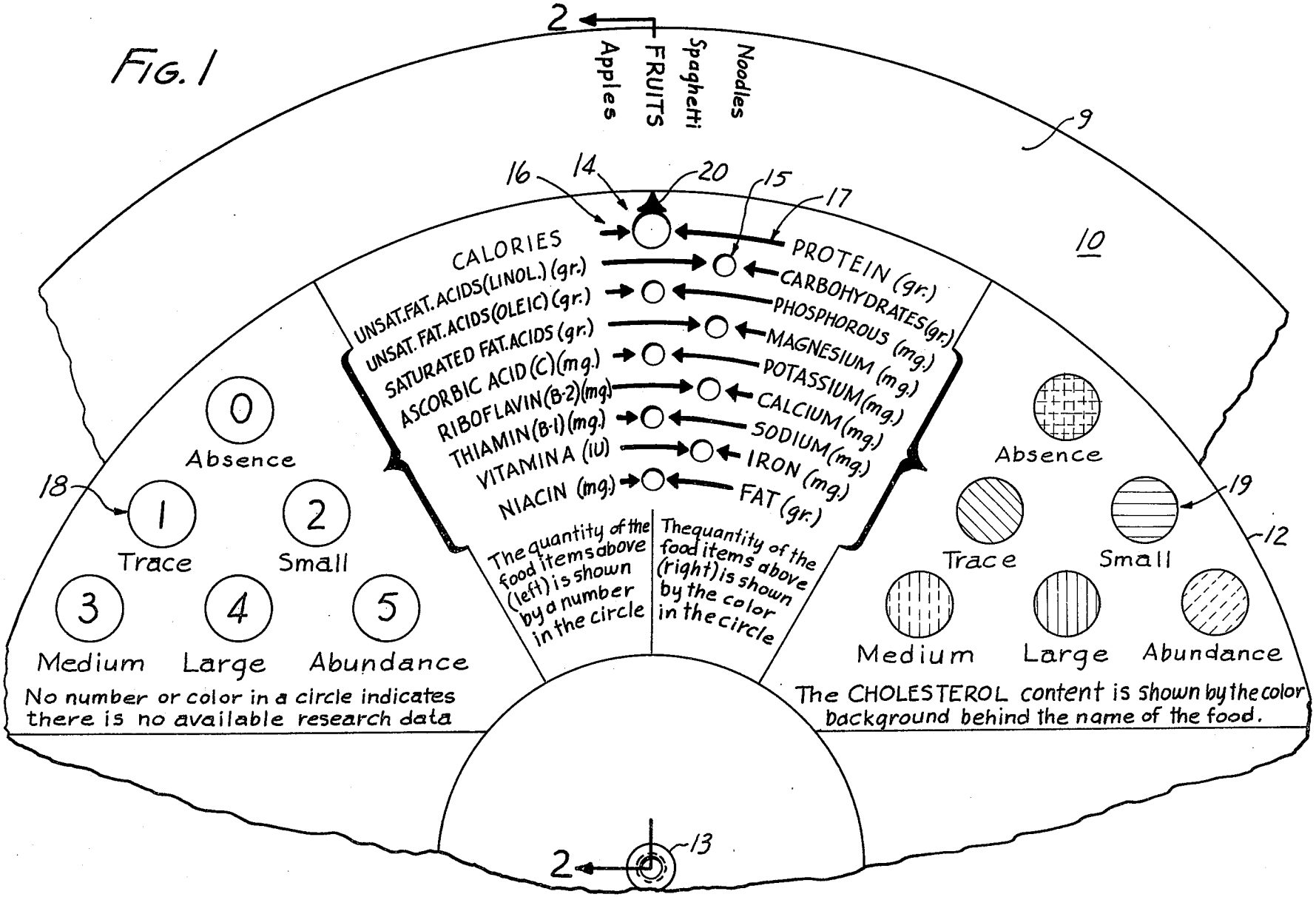
FIG. 1 is a face view of a portion of one side of a device according to this invention.

Referring to the drawing, the device comprises a circular sheet 10 of a stiff material, such as cardboard or plastic or the like, and two flat wheels 11 and 12 which may be sheets of material similar to that used for chart 10, overlying opposite sides of the circular sheet 10, the sheets 10, 11 and 12 being pivoted to each other by a pivot 13. The wheel sheets 11 and 12 are both of the same diameter and the sheet 10 is of larger diameter than sheets 11 and 12, so that sheet 10 contains a marginal peripheral portion, uncovered by either of the wheels 11 and 12. The peripheral portion 9 contains the names of foods, three of which are shown in FIG. 1, namely, noodles, spaghetti and apples. The words "FRUITS" shown in FIG. 1 is merely a heading for all the fruits which are to be included, which, in addition to apples, may be apricots, bananas, blackberries, boisenberries, casaba melon, cherries, cranberries, dates, figs, grapefruit, grapes, lemons and many others, preferably arranged in alphabetical order and uniformly spaced from each other in a counterclockwise arrangement around the periphery 9, following apples. Noodles and spaghetti are shown as the last members under a food group labeled "FLOUR" which may, for example, include in a clockwise arrangement from noodles, macaroni and corn meal. For greater accuracy the individual foods may be described more specifically than by their common name. For example, macaroni may be marked "Cooked and enriched", noodles may be marked "Egg, cooked, enriched" and spaghetti may be marked Cooked, enriched.

Figure 3:
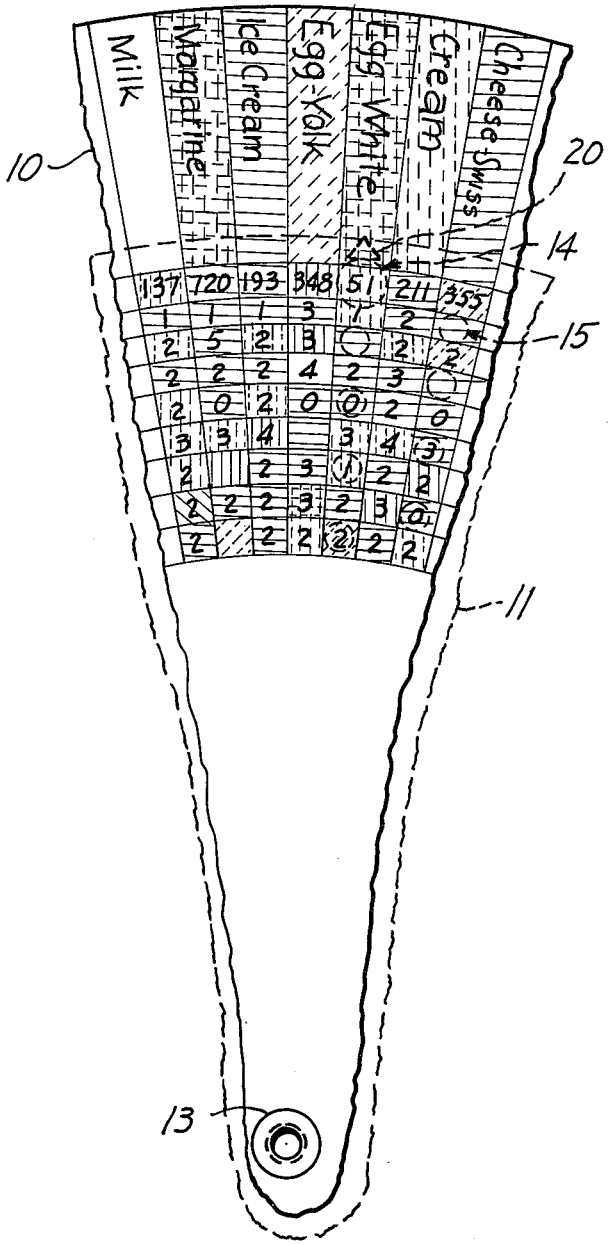
FIG. 3 is a partial face view of the device looking from the opposite side from that shown in FIG. 1, and with the wheel element at that side removed to show the chart arrangement beneath the wheel.
Figure 2:
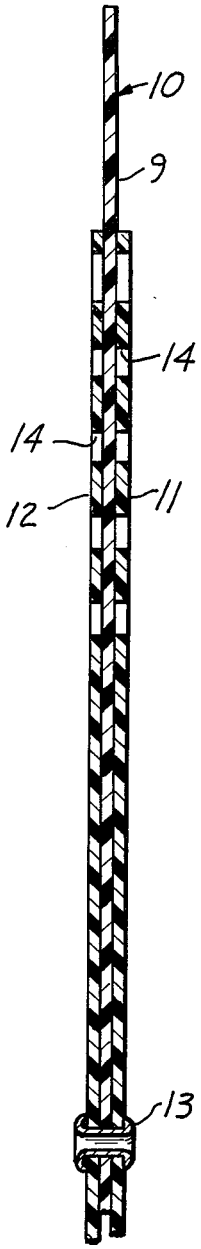
FIG. 2 is a cross-section view taken at line 2—2 of FIG. 1.

The periphery 9 will contain the names of other kinds and classes of food, for example Beverages, Breads, Meats, Miscellaneous and Nuts, and following each captioned class there will follow the names of individual foods in the class. Where a food has any of a number of forms such as cooked or raw, roasted, stewed or the like, these specific descriptions may be added. The peripheral portion of the opposite sides of sheet 10 likewise contains the names of other foods as shown in FIG. 3, which shows cheese-swiss, cream, egg white, egg yolk, ice cream, margarine and milk, these being some of the foods appearing under the heading DAIRY FOODS. The arrangement of foods on the back side of chart 10 shown in FIG. 3 is similar to that shown on the side of FIG. 1. Thus the side shown in FIG. 3 may contain other members of the dairy food group and also contain the names of foods under such groups as CEREAL AND GRAIN, SEAFOOD and VEGETATABLES. In a chart 10 having a ten-inch diameter as many as one hundred or more foods may be listed.

The exposed faces of wheels 11 and 12 are identical to each other. The operational portion of wheel 12 is shown in FIG. 1 and it is understood that the operational portion of wheel 11 will be identical. Hence, the material shown on the face of wheel 12 will appear on the face of wheel 11 in the same manner. Each wheel contains two columns of holes 14 and 15 extending radially from the pivot 13 toward the periphery of the wheel. The holes of each column are spaced substantially uniformly apart, and toward the outer periphery of the wheel because of the greater amount of space on the wheel at its periphery than inward toward its center. The two columns are also spaced radially apart for a conveniently short distance. The purpose of these columns of holes is to uncover indicia showing relatively quantities of food items located in radially extending columns or sectors on chart 10 within the periphery of the wheel. Except for what is seen through the holes, nothing is seen through the wheel, which is opaque.

The food items or values are shown on the wheel. At the left side of the columns of holes these food items or values are shown as calories, unsaturated fatty acids (linoleic), unsaturated fatty acids (oleic), saturated fatty acids, ascorbic (C), riboflavin (B-2), thiamin (B-1), Vitamin A and niacin. The quantities are indicated as grams or milligrams (or IU for vitamin A) contained in 100 grams of edible portions. To the right of the columns of holes there are the food items labeled as protein, carbohydrates, phosphorous, magnesium, potassium, calcium, sodium, iron and fat, indicated as grams or milligrams contained in 100 grams of edible portions.

From each food item at the left side of the columns there extends an arrow 16 pointing toward one of the holes of the columns, and from each food item at the right side there extends an arrow 17 pointing toward one of the holes of the columns of holes. At the far left side of wheel 12 there are circles 18 each containing a number from 0 to 5, the number 0 representing the absence of any quantity, the number 1 indicating a trace, the number 2 indicating a small quantity, the number 3 indicating a medium quantity, the number 4 indicating a large quantity and the number 5 indicating an abundance, of a food item. At the right side of wheel 12 there are six circles 19 each containing a different color, which is the color for which the area within the circle is lined. Thus the circle 19 beneath which is the designation "ABSENCE" is lined for yellow; the circle beneath which is the designation "TRACE" is lined for green; the circle beneath which is the designation "SMALL" is lined for blue; the circle beneath which is the designation "MEDIUM" is lined for purple; the circle below which is the designation "LARGE" is lined for red; and the circle below which is the designation "ABUNDANCE" is lined for orange. The arrows 16 pointing from left to right toward respective circles 18 relate to the numbers 0 to 5, and the arrows pointing from right to left to respective circles 19 relate to the respective colors.

Referring again to the chart 10, this contains colors in correspondence with colors in circles 19 and also it contains numbers in correspondence with the numbers in circles 18. This is indicated in FIG. 3 which contains the portion of one side of the chart 10 containing the names of the foods cream, egg white, egg yolk, ice cream, margarine and milk as noted above. The area around each of these food names is given a color. Thus the area at which the word cream appears is lined for color purple; the area at which the words egg white appear is lined for yellow; and the area at which the words egg yolk appear is lined for orange; the area at which the words ice cream appear is lined for blue; the area at which the word margarine appears is lined for yellow; and the area at which the word milk appears is uncolored, this being the background color of the surfaces of chart 10, preferably white. These colors at the food names represent relative amounts of cholesterol in the respective food. Where there is no color there has been no research data available on cholesterol for that food.

At the lefthand column of holes shown in FIG. 1 there is placed an arrow 20 which is to be pointed to the name of a food (by properly rotating the wheel) for the purpose of reading its cholesterol value. In FIG. 1 the arrow 20 happens to be pointed to FRUITS, which is simply a group name and hence will have no food or cholesterol values or quantities assigned to it in the chart.

Referring again to FIG. 3, part of the wheel 11 is shown in phantom as it overlies the chart 10. The columns of holes 14 and 15 are also shown in phantom. The arrow 20 and the column of holes 14 are pointing to the food egg white. Since the area of food egg white is colored yellow, it is shown to have an absence of cholesterol. If the wheel 11 were turned so that the pointer (the arrow 20 or the left column of holes) registers with another food, for example egg yolk, colored orange, it is seen that egg yolk has an abundance of cholesterol. In a similar manner the relative quantity of cholesterol of other foods is indicated by properly turning the wheel, provided the cholesterol content has been available to apply to the chart in color.

The radial columns or sectors of the chart 10 contain numbers and colors arranged radially inward from the outer periphery of the wheel, and occupying the same areas, as shown in FIG. 3. Hence all of these numbers and colors are covered by the wheel except those revealed through the holes of the wheel. The first number on the chart in a column inward from the area containing the food name represents calories in the food. The number for calories of egg white is shown, for example, to be 51 which means 51 calories per hundred grams.

Referring now to FIG. 1 which shows the opposite side of the chart over which is the wheel 12 which is identical to wheel 11, it is seen that the arrow 16 from the word calories extends from left to right, which is the reason for reading the number seen through the hole to which this arrow points, as being the number of calories rather than as being related in any way to the word protein from which an arrow 17 extends from right to left. As indicated previously the left-to-right arrows are for reading numbers and the right-to-left arrows are for reading colors. Referring to the color seen through this same hole, it is noted that the space occupied by number 51 under egg white is lined for purple, and since the arrow from protein points to it the significance is that egg white contains a medium amount of protein.

Referring to the righthand column of holes 15 shown in phantom in FIG. 3, it is seen that the portion of the chart beneath the outermost hole 15 is colored blue, but contains no number. The significance of this is that since there is no number the amount of unsaturated fatty acid (linoleic) is unavailable, but since the color seen through that hole is blue, egg white is seen to contain a small amount of carbohydrate since the arrow applicable to color extends from right to left from the word carbohydrates.

It is noted that the left column of holes serves as an indicator of registration with the words "egg white", hence, the use of arrow 20 is not essential, although it is desirable. It is also noted that all of the information pertaining to egg white is not included in one sector or column of chart 10, as part of the information is included in a column which happens to be aligned with "cheese-swiss", located two sectors to the right of that which is aligned with egg white. This is where the right column of holes is located. The indicia seen through the holes of the right column pertains to egg white and not to cheese-swiss. If the wheel now be rotated so that arrow 20 and the left column of holes aligns with the words cheese-swiss the indicia revealed through the righthand column of holes when the wheel was registered with egg white, would not be seen, because the holes of the left column are at different distances from the center of the wheel than the holes of the righthand column.

The same situation and procedure indicated for egg white is applicable to all the foods for which there is a color or a number indicated.

The use of both sides of the chart and the provision of a wheel at each side permits a maximum amount of food information to be included in a device of a given size. Furthermore, the use of two kinds of indicia occupying the same areas to be uncovered by the holes, such as the number system and the color system described and illustrated herein permits a great amount of food item or value information to be included in a relatively small space, and the use of the color system for cholesterol at the peripheral part of the chart contributes toward this conservation of space.

From the foregoing description and drawings it is seen that by this invention there is provided an easy-to-read device for quickly ascertaining relative values of cholesterol and food items including vitamins, as well as the number of calories per unit of weight, of a great many foods. This is made easy through use of the several indicia systems, a first of which is shown in the form of food names, the second in the form of numbers, the third in the form of colors and the fourth in the form of colors associated with the food names. It will be recognized that the indicia need not necessarily be in the form of words, numbers and colors, although those particular indicia systems are considered to be the most convenient. For example, one form of indicia system could comprise the color coding system used to indicate the colors, or different geometric forms could be used to indicate relative quantities.

To illustrate the simplicity of using the system, assume that it is desired to select a food having no cholesterol. This can be done without even turning the wheels simply by looking for the color yellow as a background from which it can be seen that egg white and margarine are indicated. Again, as an example, assume it is desired to select a food containing a large or abundant amount of protein. These can quickly be ascertained by turning the wheels and inspecting the colors at the holes of the wheels to which the arrow from the word "protein" extends, and selecting those foods for which the color seen through that hole is either red or orange. The same situation applies to ascertaining foods having a desired amount of the other food items.

It will be understood that the embodiments of the invention illustrated and described herein are given by way of illustration and not of limitation, and that modifications or equivalents or alternatives with the scope of the invention may suggest themselves to those skilled in the art.

What is claimed is:

1. A nutrition indicating device comprising:

a chart and a wheel rotatably pivoted to the chart;

said chart comprising a first flat sheet containing on a side thereof, first indicia representing the names of a plurality of different foods arranged in spaced angular relationship to each other on a peripheral portion of the chart, and a plurality of radially oriented columns of second and third indicia representing relative quantities of food items, each individual one of said second and third indicia representing the relative quantity of an individual one of the food items;

said wheel comprising a second flat sheet covering a portion of the chart but leaving said first indicia uncovered;

said wheel containing a first radially extending column of spaced holes at least some of which uncover elements of both said second and third indicia and also a second radially extending column of spaced holes at least some of which uncover elements of both said second and third indicia; and means indicating the food of the first indicia of the chart to be selected for registration with the wheel so that its said columns of holes uncover second and third indicia for the selected one of the foods represented in the first indicia.

2. A device according to claim 1 in which the first indicia comprise words which are the names of respective foods; the second indicia represent numbers which indicate relative quantities of food items; and the third indicia are colors, different ones of which indicate relative quantities of food items; said wheel containing the names of food items of the foods and means relating each of the last-mentioned names to a hole of the wheel.

3. A device according to claim 2 in which the distances from the pivot of holes of the first column are different from the distances from the pivot of holes of the second column.

4. A device according to claim 3 in which the two radial columns of holes are adjacent and the names of food items of the foods are in columns at opposite side of the columns of holes, there being a pointing means from an individual food item in each food item column to an individual one of the holes, one of the last-mentioned pointing means denoting the color revealed by the respective hole and the other of the last-mentioned pointing means denoting the number revealed by the same respective hole.

5. A device according to claim 4 including fourth indicia in the form of colors located at said names of respective foods, to represent relative quantities of cholesterol in the respective foods.

* * * * *

UNITED STATES PATENT OFFICE

CERTIFICATE OF CORRECTION

Patent No. 3,977,106 Dated August 31, 1976

Inventor(s) LOIS KAPP

It is certified that error appears in the above-identified patent and that said Letters Patent are hereby corrected as shown below:

| | |
|---|---|
| Col. 1, line 14 | "calory" should read --calorie-- |
| Col. 2, line 14 | "words" should read --word-- |
| Col. 2, line 17 | "boisenberries" should read --boysenberry-- |
| Col. 2, line 30 | place quotation marks around --Cooked, enriched-- |
| Col. 2, line 48 | change "VEGETATA" to --VEGETA-- |
| Col. 2, lines 65-66 | "relatively" should read --relative-- |
| Col. 3, line 12 | "phosphorous" should read --phosphorus-- |
| Col. 4, line 27 | "51" second occurrence should read --fifty-one-- |
| Col. 4, line 61 | place quotation marks around --egg white-- |
| Col. 5, line 13 | insert a comma after "herein" |
| Col. 5, line 52 | "with" should read --within-- |
| Col. 6, line 43 (Cl. 4, line 3) | "side" should read --sides-- |

Signed and Sealed this

First Day of March 1977

[SEAL]

*Attest:*

RUTH C. MASON
*Attesting Officer*

C. MARSHALL DANN
*Commissioner of Patents and Trademarks*